US010947463B2

(12) United States Patent
Zhang et al.

(10) Patent No.: US 10,947,463 B2
(45) **Date of Patent: *Mar. 16, 2021**

(54) PHOSPHORUS REMOVAL AND ALKYLATE PRODUCTION

(71) Applicant: Lyondell Chemical Technology, L.P., Houston, TX (US)

(72) Inventors: Lei Zhang, Houston, TX (US); Daniel F. White, Houston, TX (US)

(73) Assignee: Lyondell Chemical Technology, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/563,350

(22) Filed: Sep. 6, 2019

(65) Prior Publication Data

US 2020/0087588 A1 Mar. 19, 2020

Related U.S. Application Data

(60) Provisional application No. 62/731,554, filed on Sep. 14, 2018.

(51) Int. Cl.

| | |
|---|---|
| ***C10G 63/02*** | (2006.01) |
| ***C10G 29/20*** | (2006.01) |
| ***C10G 50/00*** | (2006.01) |

(52) U.S. Cl.

CPC ..... *C10G 63/02* (2013.01); *C10G 29/20* (2013.01); *C10G 50/00* (2013.01); *C10G 2300/202* (2013.01); *C10G 2300/305* (2013.01); *C10G 2400/20* (2013.01); *C10G 2400/22* (2013.01)

(58) Field of Classification Search

None

See application file for complete search history.

(56) References Cited

U.S. PATENT DOCUMENTS

| | | | | |
|---|---|---|---|---|
| 3,482,001 | A | 12/1969 | Eberhardt | |
| 3,709,953 | A | 1/1973 | Bergem et al. | |
| 6,492,568 | B1 | 12/2002 | Murray et al. | |
| 9,156,747 | B2 * | 10/2015 | Martins | C10G 29/205 |
| 10,011,781 | B2 * | 7/2018 | Zhang | C07C 7/1485 |
| 2003/0149313 | A1 | 8/2003 | Murray et al. | |
| 2004/0068154 | A1 * | 4/2004 | Small | C07C 11/107 585/745 |
| 2005/0137439 | A1 * | 6/2005 | Smith | B01J 4/002 585/639 |
| 2013/0345482 | A1 | 12/2013 | Martins et al. | |
| 2016/0115102 | A1 | 4/2016 | Leyshon et al. | |
| 2018/0127662 | A1 | 5/2018 | Zhang et al. | |

OTHER PUBLICATIONS

The Extended European Search Report for EP 19194010.5 dated Jan. 16, 2020.

* cited by examiner

*Primary Examiner* — Derek N Mueller

(57) ABSTRACT

Methods of reducing a phosphorus content of a liquid hydrocarbon. The liquid hydrocarbon may be co-fed with an olefin to an alkylation unit to produce a low-phosphorus content liquid hydrocarbon product.

8 Claims, No Drawings

PHOSPHORUS REMOVAL AND ALKYLATE PRODUCTION

CROSS-REFERENCE TO RELATED APPLICATIONS

This application claims the benefit of priority to U.S. Provisional Patent Application No. 62/731,554, filed on Sep. 14, 2018, which is incorporated herein by reference in its entirety.

BACKGROUND

The removal of phosphorus containing compounds from liquid hydrocarbons and fractions that are used to make hydrocarbon fuels, such as kerosene, gasoline, jet fuel, diesel, etc., is often necessary to meet certain requirements.

Hydrocarbon effluent from a propylene metathesis production process or olefin conversion technology is one of the feedstocks that may be blended together with other hydrocarbon fractions to make other products, such as gasoline.

Hydrocarbon effluent from these processes may be a byproduct of a butenes-producing process that relies on the dimerization of ethylene. When catalysts using phosphorus-based ligands are used in the butenes-producing process, the resulting liquid hydrocarbon may contain phosphorus compounds, for example, as free ligands. In some instances, the presence of these phosphorus compounds may make the liquid hydrocarbon less suitable for blending into gasoline or other products.

For example, ethylene dimerization reactions typically utilize a catalyst to produce butenes, along with higher molecular weight hydrocarbon byproducts and catalyst decomposition products to form a liquid hydrocarbon, as shown in the following scheme:

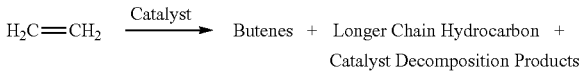

When the reaction is undergoing this dimerization of ethylene into butene, at least a portion of the catalyst decomposition byproducts may remain soluble in the reaction mixture. As a result, the liquid hydrocarbons, which may include longer chain hydrocarbon byproducts, may contain relatively high levels of phosphorus after separation. The presence of the phosphorus at certain levels can be disadvantageous, because if the liquid hydrocarbon is added to gasoline, the phosphorus content of the gasoline mixture may exceed the pipeline specification limit of 0.0038 gram per gallon. Therefore, in order to allow the liquid hydrocarbon to be blended with gasoline in refinery processing, the phosphorus content of the byproduct should, in some instances, be below 35 wtppm. When this threshold is exceeded, the amount of the byproduct that can be added to the gasoline is reduced, which may negatively impact the economics of the process.

Processes for reducing the content of phosphorus containing compounds have been devised, including distillation and treatment with an oxidizing agent to convert the phosphorus containing compounds to oxides, a portion of which can be removed due to their higher water solubility. These processes, however, typically are expensive, time-consuming, multi-step, and/or high temperature procedures.

Methods for effectively and efficiently reducing the concentration of phosphorus in liquid hydrocarbons are therefore desirable.

SUMMARY

In general, the present disclosure provides methods for reducing phosphorus content in liquid hydrocarbon by using the hydrocarbon olefinic nature as a minor alkylation olefin co-feed (to remove the phosphorus) and upgrade the liquid hydrocarbon to a higher octane number gasoline additive.

This summary is provided to introduce a selection of concepts that are further described below in the detailed description. However, many modifications are possible without materially departing from the teachings of this disclosure. Accordingly, such modifications are intended to be included within the scope of this disclosure as defined in the claims.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

Flex gasoline comprises olefinic byproducts generated from a flexible production unit operating in a dimer mode. Operation in dimer mode leads to the accumulation of phosphorus in the flex gasoline and, at times, the phosphorus content can exceed 50 ppm. A typical flex gasoline composition obtained from running the unit in dimer mode is provided in Table 1 below.

| P (wtppm) | C4s (wt %) | C5s (wt %) | C6s (wt %) | C7+ (wt %) |
|---|---|---|---|---|
| 42 | 5 | 30 | 60 | 5 |

The use of an ethylene dimerization catalyst in the flex unit, e.g., dichlorobis(tributylphosphine)nickel(II), may leave hydrocarbon soluble phosphorus in the form of phosphine, e.g., tributylphosphine (n-Bu3P) or tributyl phosphate (TBP), in the heavy stream (i.e., the liquid hydrocarbon) during dimer operation.

The phosphorus-containing liquid hydrocarbon may then be co-fed with an olefin feed to an alkylation unit wherein the phosphorus is removed from the liquid hydrocarbon and the octane number of the liquid hydrocarbon is increased.

Definitions

The terms "phosphine" and "phosphane" are used synonymously herein. When used without the "substituted" modifier these terms refer to a compound of the formula PR3, wherein each R is independently hydrogen, alkyl, cycloalkyl, alkenyl, aryl, or aralkyl, as those terms are defined above. The terms "trialkylphosphine" and "trialkylphosphane" are also synonymous. Such groups are a subset of phosphine, wherein each R is an alkyl group.

The phrase "phosphorus containing compounds" is used to refer to compounds containing one or more phosphorus atoms with the molecular formula. The term "phosphorus" when used in the context of a composition refers to a composition containing one or more phosphorus compounds as that term is defined above or elemental phosphorus. Alternatively, this term may also be used to reference to the concentration of phosphorus atoms in the composition.

The use of the word "a" or "an," when used in conjunction with the term "comprising" in the claims and/or the specification may mean "one," but it is also consistent with the meaning of "one or more," "at least one," and "one or more than one."

Throughout this application, the term "about" is used to indicate that a value includes those within ±10% of the indicated number.

The terms "comprise," "have" and "include" are open-ended linking verbs. Any forms or tenses of one or more of these verbs, such as "comprises," "comprising," "has," "having," "includes" and "including," are also open-ended. For example, any method that "comprises," "has" or "includes" one or more steps is not limited to possessing only those one or more steps and also covers other unlisted steps.

The term "hydrocarbon" is used to refer to a composition of organic compounds contain one or more carbon atoms and comprises at least 90% molecules with only carbon and hydrogen. The term "liquid hydrocarbon" and "hydrocarbon by-product" are used interchangeably to refer to a composition containing multiple different aliphatic, aromatic, or both compounds from a composition arising from the production of butene or other higher carbon length products such as gasoline. The term "hydrocarbon effluent" or "reactor effluent" is a subset of liquid hydrocarbon wherein the liquid hydrocarbon is from a chemical process, such as an ethylene dimerization process to produce butene, and may contain C5 or longer hydrocarbons.

A "method" is series of one or more steps undertaking lead to a final product, result or outcome. As used herein, the word "method" is used interchangeably with the word "process".

The above definitions supersede any conflicting definition in any reference that is incorporated by reference herein. The fact that certain terms are defined, however, should not be considered as indicative that any term that is undefined is indefinite. Rather, all terms used are believed to describe the disclosure in terms such that one of ordinary skill can appreciate the scope and practice the present disclosure.

EXAMPLES

The present invention is further illustrated by the following examples, which are not to be construed in any way as imposing limitations upon the scope thereof. On the contrary, it is to be clearly understood that resort may be had to various other aspects, embodiments, modifications, and equivalents thereof which, after reading the description herein, may suggest themselves to one of ordinary skill in the art without departing from the spirit of the present invention or the scope of the appended claims. Thus, other aspects of this invention will be apparent to those skilled in the art from consideration of the specification and practice of the invention disclosed herein.

As summarized in Table 1 below, two trials were conducted. In the first trial, 4.1 vol % flex gasoline was co-fed with olefins to an alkylation unit. In the second trial, 5.3 vol % flex gasoline was co-fed with olefins to the alkylation unit.

TABLE 1

Alkylation Trial Results

| | Alkyl average | Pre-Trial | Trial Results | | Post-Trial |
|---|---|---|---|---|---|
| Flex gasoline rate (GPM) | 0 | 0 | 15 | 20 | 0 |
| Flex in olefin (vol %) | 0 | 0 | 4.1 | 5.3 | 0 |
| Alkylate (bpd) | 21000 | 22000 | 23000 | 24000 | 22000 |
| Acid consumption (lb/gal) | 0.67 | 0.64 | 0.64 | 0.63 | 0.62 |
| Alkyl yield (alkyl/O) | 1.62 | 1.78 | 1.84 | 1.84 | 1.71 |
| Tray 2 (° F.) | 267 | 267 | 269 | 273 | 271 |
| Tray 11 (° F.) | 173 | 173 | 176 | 178 | 174 |
| ON-IR (No Spec) | 93.1 | 93.0 | 92.6 | 92.7 | 93.1 |
| D86 EP (≤425° F.) | 395 | 398 | 405 | 406 | 398 |
| Recovery (>97%) | 98.2 | 98.3 | 98.3 | 98.6 | 98.5 |
| RVP (≤5 psia) | 4.4 | 4.3 | 4.6 | 4.2 | 4.3 |
| P in alkylate (mg/gal) | <0.8 | <0.8 | <0.8 | <0.8 | <0.8 |
| P in spent acid (wtppm) | 0 | 0 | 8.8 | 12.2 | 0 |

The data of Table 1 demonstrates that in both trials, the phosphorus content of the flex gasoline was retained in the acid in the alkylation unit. In both trials, the alkylate quality remained in specification with the residual phosphorus content less than 0.8 mg/gal.

Although a few embodiments of the disclosure have been described in detail above, those of ordinary skill in the art will readily appreciate that many modifications are possible without material departing from the teachings of this disclosure. Accordingly, such modifications are intended to be included within the scope of this disclosure as defined in the claims. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

ADDITIONAL DISCLOSURE

The particular embodiments disclosed above are merely illustrative, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and such variations are considered within the scope and spirit of the present disclosure. Alternative embodiments that result from combining, integrating, and/or omitting features of the embodiment(s) are also within the scope of the disclosure. While compositions and methods are described in broader terms of "having", "comprising," "containing," or "including" various components or steps, the compositions and methods can also "consist essentially of" or "consist of" the various components and steps. Use of the term "optionally" with respect to any element of a claim means that the element is present, or alternatively, the element is not present, both alternatives being within the scope of the claim.

Numbers and ranges disclosed above may vary by some amount. Whenever a numerical range with a lower limit and an upper limit is disclosed, any number and any included range falling within the range is specifically disclosed. In particular, each range of values (of the form, "from about a to about b," or, equivalently, "from approximately a to b," or, equivalently, "from approximately a-b") disclosed herein is to be understood to set forth each number and range encompassed within the broader range of values. Also, the terms in the claims have their plain, ordinary meaning unless otherwise explicitly and unambiguously defined by the patentee. Moreover, the indefinite articles "a" or "an", as used in the claims, are defined herein to mean one or more than one of the element that it introduces. If there is any conflict in the usages of a word or term in this specification and one or more patent or other documents, the definitions that are consistent with this specification should be adopted.

What is claimed is:

1. A method for reducing phosphorus content, the method comprising:

contacting a liquid hydrocarbon with an olefin in an alkylation unit, wherein the liquid hydrocarbon comprises a phosphorus containing compound and wherein the liquid hydrocarbon has an initial octane number;

alkylating the liquid hydrocarbon and olefin to produce a product having an octane number greater than the initial octane number of the liquid hydrocarbon, wherein the product has a phosphorus content less than about 35 wtppm.

2. The method according to claim 1 wherein the liquid hydrocarbon comprises C5s and C6s.

3. The method according to claim 1 wherein the phosphorus containing compound is a hydrocarbon soluble phosphine.

4. The method according to claim 1 wherein the phosphorus containing compound is a tributyl phosphine.

5. The method according to claim 1 wherein the phosphorus of the phosphorus containing compound transferred to an acid component contained in the alkylation unit.

6. The method according to claim 1 wherein the product has a phosphorus content less than about 20 wtppm.

7. The method according to claim 1 wherein the product has a phosphorus content less than about 15 wtppm.

8. The method according to claim 1 wherein the product has a phosphorus content less than about 10 wtppm.

* * * * *